US010826245B2

(12) United States Patent
Chen et al.

(10) Patent No.: US 10,826,245 B2
(45) Date of Patent: Nov. 3, 2020

(54) ELECTRICAL CONNECTOR ASSEMBLY AND MALE CONNECTOR

(71) Applicant: TOPCONN ELECTRONIC (KUNSHAN) CO., LTD., Suzhou, Jiangsu Province (CN)

(72) Inventors: Chih-Wei Chen, New Taipei (TW); Chung-Nan Pao, New Taipei (TW); Yueh-Lin Yang, New Taipei (TW); Yu-Hsiung Lin, New Taipei (TW); Kai Wu, Guangdong (CN)

(73) Assignee: STARCONN ELECTRONIC (Su Zhou) Co., LTD, Kunshan (CN)

( * ) Notice: Subject to any disclaimer, the term of this patent is extended or adjusted under 35 U.S.C. 154(b) by 0 days.

(21) Appl. No.: 16/568,258

(22) Filed: Sep. 12, 2019

(65) Prior Publication Data

US 2020/0287333 A1 Sep. 10, 2020

(30) Foreign Application Priority Data

Mar. 5, 2019 (CN) ..... 2019 1 0162809

(51) Int. Cl.
*H01R 13/6586* (2011.01)
*H01R 13/514* (2006.01)
*H01R 13/41* (2006.01)

(52) U.S. Cl.
CPC ..... *H01R 13/6586* (2013.01); *H01R 13/41* (2013.01); *H01R 13/514* (2013.01)

(58) Field of Classification Search
CPC ..... H01R 13/6585; H01R 13/6586; H01R 13/6587; H01R 13/514; H01R 13/41
USPC ..... 439/607.05–607.07
See application file for complete search history.

(56) References Cited

U.S. PATENT DOCUMENTS

| | | | | |
|---|---|---|---|---|
| 7,530,846 | B1 * | 5/2009 | Chen | H01R 23/688 439/607.05 |
| 8,419,472 | B1 * | 4/2013 | Swanger | H01R 13/6587 439/607.07 |
| 8,449,330 | B1 * | 5/2013 | Schroll | H01R 13/6586 439/607.06 |
| 8,961,228 | B2 * | 2/2015 | Jeon | H01R 13/6463 439/607.07 |
| 2002/0048995 | A1 * | 4/2002 | Shindo | H01R 13/6585 439/607.07 |
| 2010/0144201 | A1 * | 6/2010 | Defibaugh | H01R 13/6586 439/607.05 |
| 2013/0017722 | A1 * | 1/2013 | Davis | H01R 13/6585 439/607.09 |

(Continued)

*Primary Examiner* — Gary F Paumen
(74) *Attorney, Agent, or Firm* — Gang Yu

(57) ABSTRACT

An electrical connector assembly, a female connector, and a male connector are provided. The electrical connector assembly includes a female connector and a male connector detachably inserted into the female connector. The female connector includes a housing and a plurality of transmission wafers inserted into the housing. Each of the transmission wafers includes an insulating frame and a plurality of grounding terminals fixed to the insulating frame. The male connector includes a carrier and a plurality of shielding terminals fixed to the carrier. Two side walls of each of the shielding terminals are respectively abutted against and electrically connected to two of the grounding terminals each having at least one first contacting portion.

12 Claims, 17 Drawing Sheets

(56) References Cited

U.S. PATENT DOCUMENTS

| | | | | |
|---|---|---|---|---|
| 2013/0210246 | A1* | 8/2013 | Davis | H01R 12/7082<br>439/65 |
| 2014/0148054 | A1* | 5/2014 | Annis | H01R 13/514<br>439/607.05 |
| 2014/0194004 | A1* | 7/2014 | Pickel | H01R 13/648<br>439/607.01 |
| 2015/0194771 | A1* | 7/2015 | Pan | H01R 13/6587<br>439/607.1 |
| 2016/0181732 | A1* | 6/2016 | Laurx | H01R 13/41<br>439/607.01 |
| 2017/0085034 | A1* | 3/2017 | De Geest | H01R 13/6585 |
| 2018/0219329 | A1* | 8/2018 | Morgan | H01R 13/6585 |
| 2018/0219330 | A1* | 8/2018 | Morgan | H01R 13/6587 |
| 2019/0131746 | A1* | 5/2019 | Morgan | H01R 13/6584 |
| 2019/0305486 | A1* | 10/2019 | Trout | H01R 13/6471 |

* cited by examiner

ELECTRICAL CONNECTOR ASSEMBLY AND MALE CONNECTOR

CROSS-REFERENCE TO RELATED PATENT APPLICATION

This application claims the benefit of priority to China Patent Application No. 201910162809.7, filed on Mar. 5, 2019 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector, and more particularly to an electrical connector assembly, a female connector, and a male connector.

BACKGROUND OF THE DISCLOSURE

A conventional electrical connector assembly applied to a high-speed signal transmission includes a female connector and a male connector connected to the female connector. However, grounding terminals of the female connector are respectively connected to grounding terminals of the male connector one to one, so that the common ground performance of the conventional electrical connector is weak, and the crosstalk of the conventional electrical connector is difficult to be decreased.

SUMMARY OF THE DISCLOSURE

In response to the above-referenced technical inadequacies, the present disclosure provides an electrical connector assembly, a female connector, and a male connector to effectively improve the issues associated with conventional electrical connector assemblies.

In one aspect, the present disclosure provides an electrical connector assembly, which includes a female connector and a male connector detachably inserted into the female connector. The female connector includes a housing and a plurality of transmission wafers stacked in one pile and inserted into the housing. Each of the transmission wafers includes an insulating frame and a plurality of grounding terminals fixed to the insulating frame. The male connector includes a carrier and a plurality of shielding terminals fixed to the carrier. At least one of the grounding terminals of each of the transmission wafers includes two first contacting portions that are spaced apart from each other and are respectively abutted against and electrically connected to two of the shielding terminals adjacent to each other.

In one aspect, the present disclosure provides a female connector, which includes a housing and a plurality of transmission wafers stacked in one pile and inserted into the housing. Each of the transmission wafers includes an insulating frame, a plurality of grounding terminals fixed to the insulating frame, and a plurality of signal terminals fixed to the insulating frame. In each of the transmission wafers, two pairs of the signal terminals adjacent to each other are provided with two of the grounding terminals that are arranged there-between and respective have two first contacting portions configured to abut against and electrically connect to two adjacent shielding terminals of a male connector.

In one aspect, the present disclosure provides a male connector, which includes a carrier, a plurality of conductive terminals fixed to the carrier, and a plurality of shielding terminals fixed to the carrier. Each of the shielding terminals includes a U-shaped sheet and two wing portions respectively connected to two opposite sides of the U-shaped sheet. The U-shaped sheet of each of the shielding terminals is arranged around an outer side of two of the conductive terminals, and the two wing portions of each of the shielding terminals are configured to respectively abut against and electrically connect to two grounding terminals of a female connector.

Therefore, the shielding terminals in the male connector and the grounding terminals in the female connector of the present disclosure can be connected in a one-to-plurality manner, thereby improving the common ground performance and the crosstalk of the electrical connector assembly of the present disclosure.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
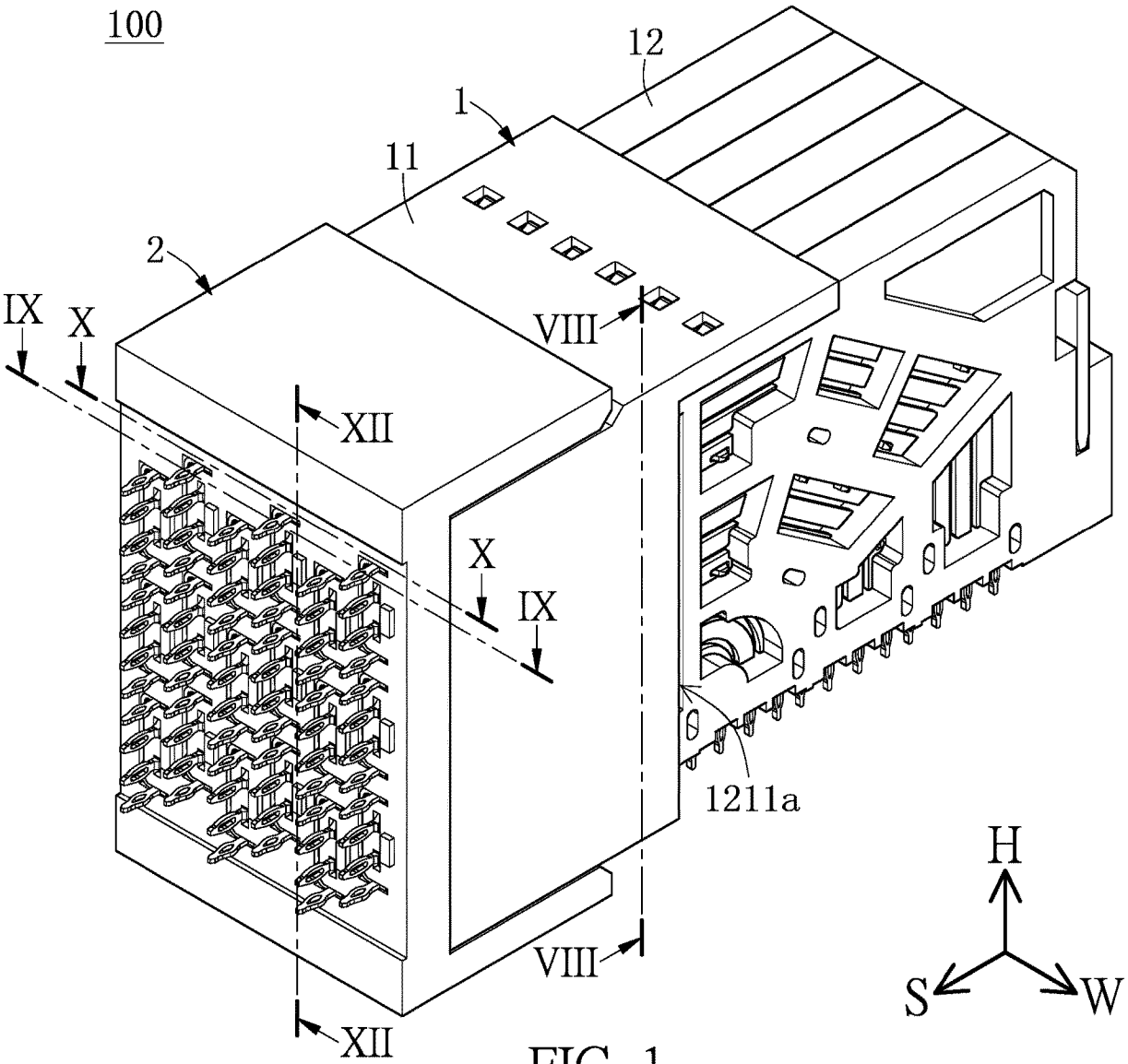
FIG. 1 is a perspective view of an electrical connector assembly according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
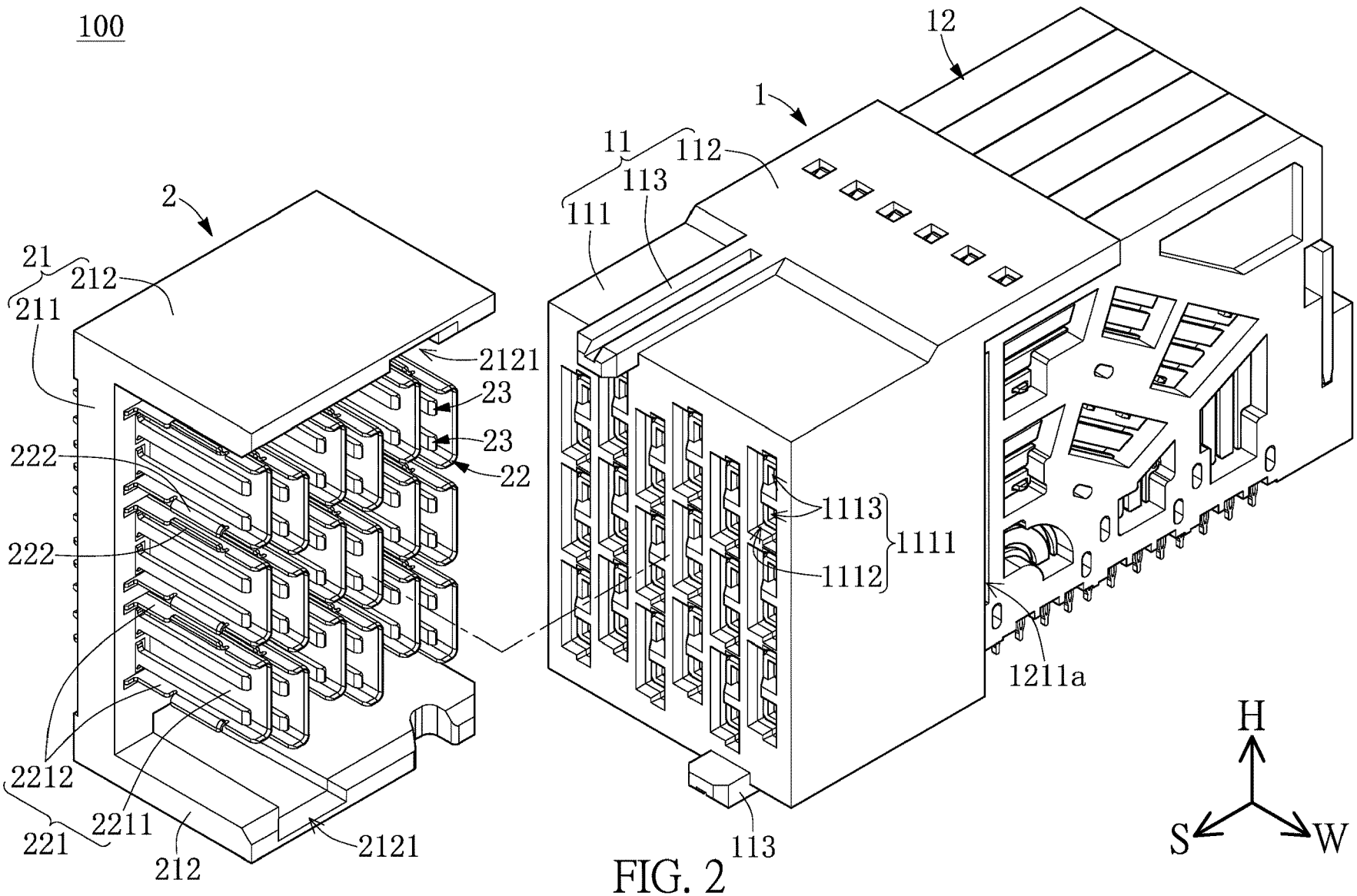
FIG. 2 is an exploded view of FIG. 1.

Referring to FIG. 1 to FIG. 12 and FIG. 17, a first embodiment of the present disclosure provides an electrical connector assembly 100 that can be applied to a server or a switchboard, but the present disclosure is not limited thereto. As shown in FIG. 1 and FIG. 2, the electrical connector assembly 100 includes a female connector 1 and a male connector 2 detachably inserted into the female connector 1 along an insertion direction S. In order to easily describe the present embodiment, the electrical connector assembly 100 further defines a width direction W and a height direction H both perpendicular to each other and perpendicular to the insertion direction S.

It should be noted that the female connector 1 and the male connector 2 in the present embodiment are in cooperation with each other, but the present disclosure is not limited thereto. In other embodiments of the present disclosure, the female connector 1 or the male connector 2 can be individually applied or can be applied to other components. The following description describes the structural and connection relationship of each of the female connector 1 and the male connector 2.

Figure 3:
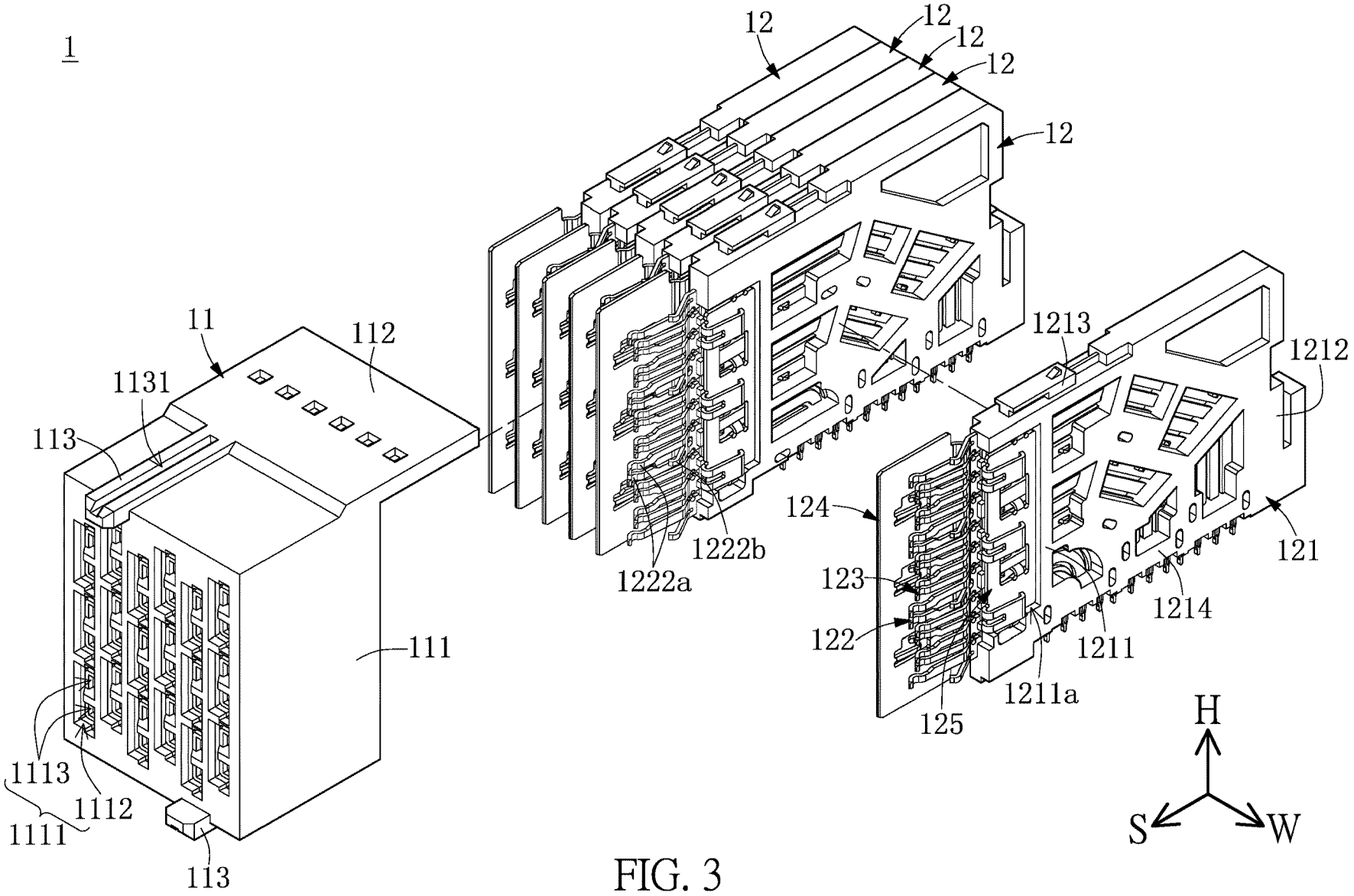
FIG. 3 is an exploded view of a female connector according to the first embodiment of the present disclosure.

As shown in FIG. 3, the female connector 1 includes a housing 11 and a plurality of transmission wafers 12 inserted into the housing 11. The transmission wafers 12 in the present embodiment are stacked in one pile along the width direction W. In addition, any one of the transmission wafers 12 in the present embodiment is in cooperation with the housing 11, but any one of the transmission wafers 12 can be individually applied or can be applied to other components in other embodiments of the present disclosure.

The housing 11 includes an insertion portion 111 being substantially a cuboid, a positioning board 112 extending from a top end of the insertion portion 111 along the insertion direction S, and two guiding columns 113 respectively formed on two opposite surfaces of the insertion portion 111 (e.g., a top surface and a bottom surface of the insertion portion 111 as shown in FIG. 2) in a staggered arrangement. The insertion portion 111 has a plurality of terminal holes 1111 penetratingly recessed in a front surface thereof and arranged in a plurality of rows, and each of the rows of the terminal holes 1111 corresponds in position to one of the transmission wafers 12. In other words, each of the rows of the terminal holes 1111 has a longitudinal direction parallel to the height direction H. Each of the rows of the terminal holes 1111 includes a plurality of grounding thru-holes 1112 and a plurality of signal thru-holes 1113. Each of the grounding thru-holes 1112 is substantially U-shaped, and two of the signal thru-holes 1113 adjacent to each other be arranged at an inner side of the U-shaped grounding thru-holes 1112.

A longitudinal direction of each of the two guiding columns 113 is parallel to the insertion direction S. The staggered arrangement of the two guiding columns 113 refers to the two guiding columns 113 not being located at the same cross-section of the height direction H. In other words, as shown in FIG. 3, one of the two guiding columns 113 is arranged at a top side of a second row of the terminal holes 1111 counting from a left side of FIG. 3, and the other one of the two guiding columns 113 is arranged at a bottom side of a fifth row of the terminal holes 1111 counting from a left side of FIG. 3.

Moreover, one end of each of the two guiding columns 113 protrudes from the insertion portion 111, and the other end of each of the two guiding columns 113 is connected to the positioning board 112. Each of the two guiding columns 113 has a groove 1131 that is recessed from the end thereof and that extends along the insertion direction S.

As shown in FIG. 3, the transmission wafers 12 are inserted into the insertion portion 111 of the housing 11, and are engaged with the positioning board 112 of the housing 11. As the transmission wafers 12 are of the same structure, the following description discloses the structure of only one of the transmission wafers 12 for the sake of brevity, but the present disclosure is not limited thereto. For example, in other embodiments of the present disclosure, the transmission wafers 12 of the female connector 1 can be different.

As shown in FIG. 3, the transmission wafer 12 of the present embodiment includes an insulating frame 121 having a substantial rectangular shape, a plurality of grounding terminals 122 fixed to the insulating frame 121, a plurality of signal terminals 123 fixed to the insulating frame 121, and a first shielding member 124 and a second shielding member 125 both respectively disposed on two opposite sides of the insulating frame 121.

The insulating frame 121 includes a front end portion 1211, a rear end portion 1212, a top end portion 1213, and a bottom end portion 1213, which are arranged on a peripheral part thereof and each have an elongated shape. A longitudinal direction of the front end portion 1211 and a longitudinal direction of the rear end portion 1212 are substantially parallel to the height direction H, and a longitudinal direction of the top end portion 1213 and a longitudinal direction of the bottom end portion 1214 are substantially parallel to the insertion direction S. In other words, the longitudinal direction of the front end portion 1211 is substantially perpendicular to that of the bottom end portion 1214.

Specifically, the insulating frame 121 has an accommodating slot 1211*a* recessed near the front end portion 1211. The accommodating slot 1211*a* in the present embodiment is an elongated structure parallel to the height direction H for receiving the second shielding member 125. The top end portion 1213 of the insulating frame 121 is engaged with the positioning board 112, and the bottom end portion 1214 of the insulating frame 121 is engaged with the insertion portion 111.

Figure 4:
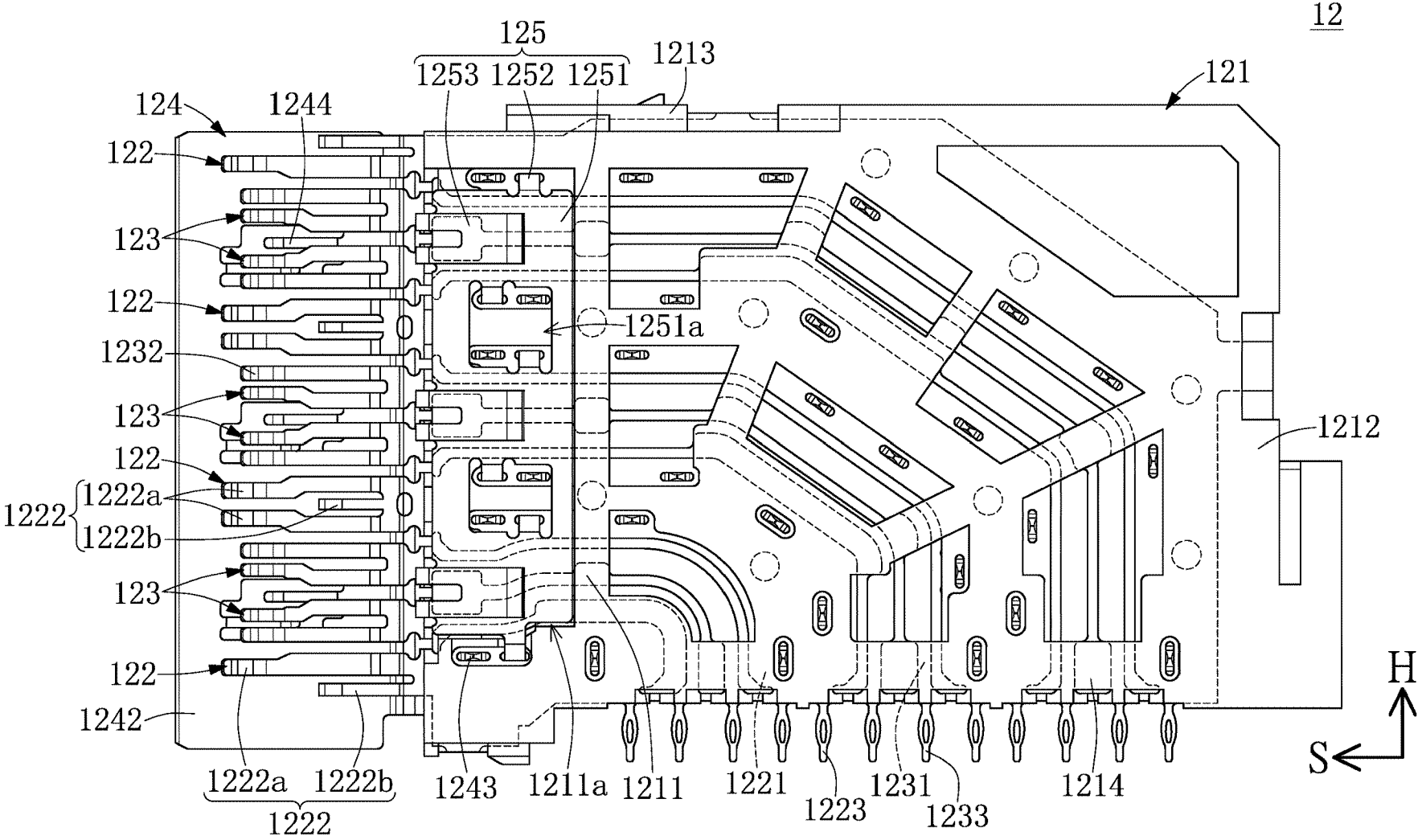
FIG. 4 is a planar view of a transmission wafer according to the first embodiment of the present disclosure.
Figure 5:
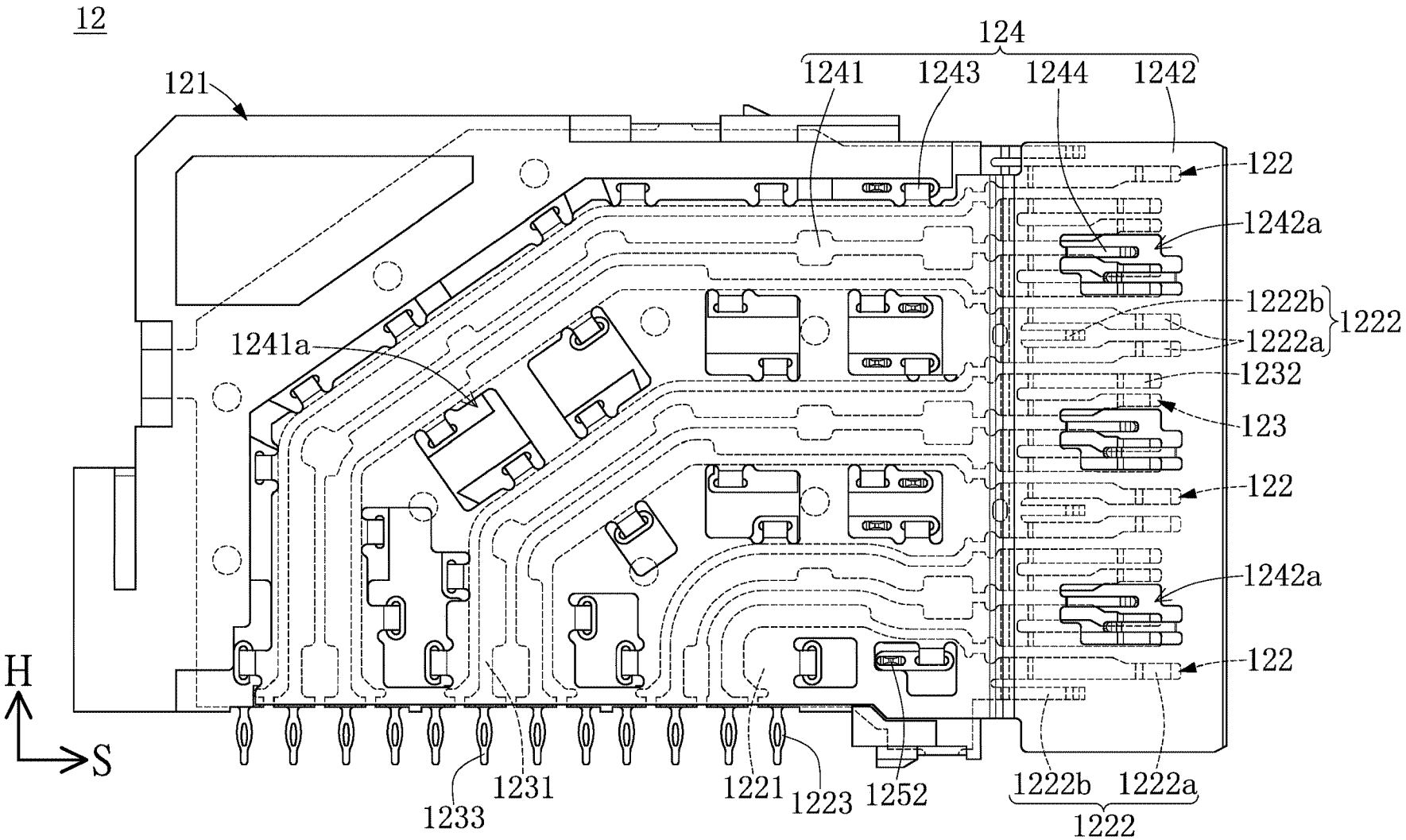
FIG. 5 is a planar view showing the transmission wafer of FIG. 4 in another angle of view.
Figure 6:
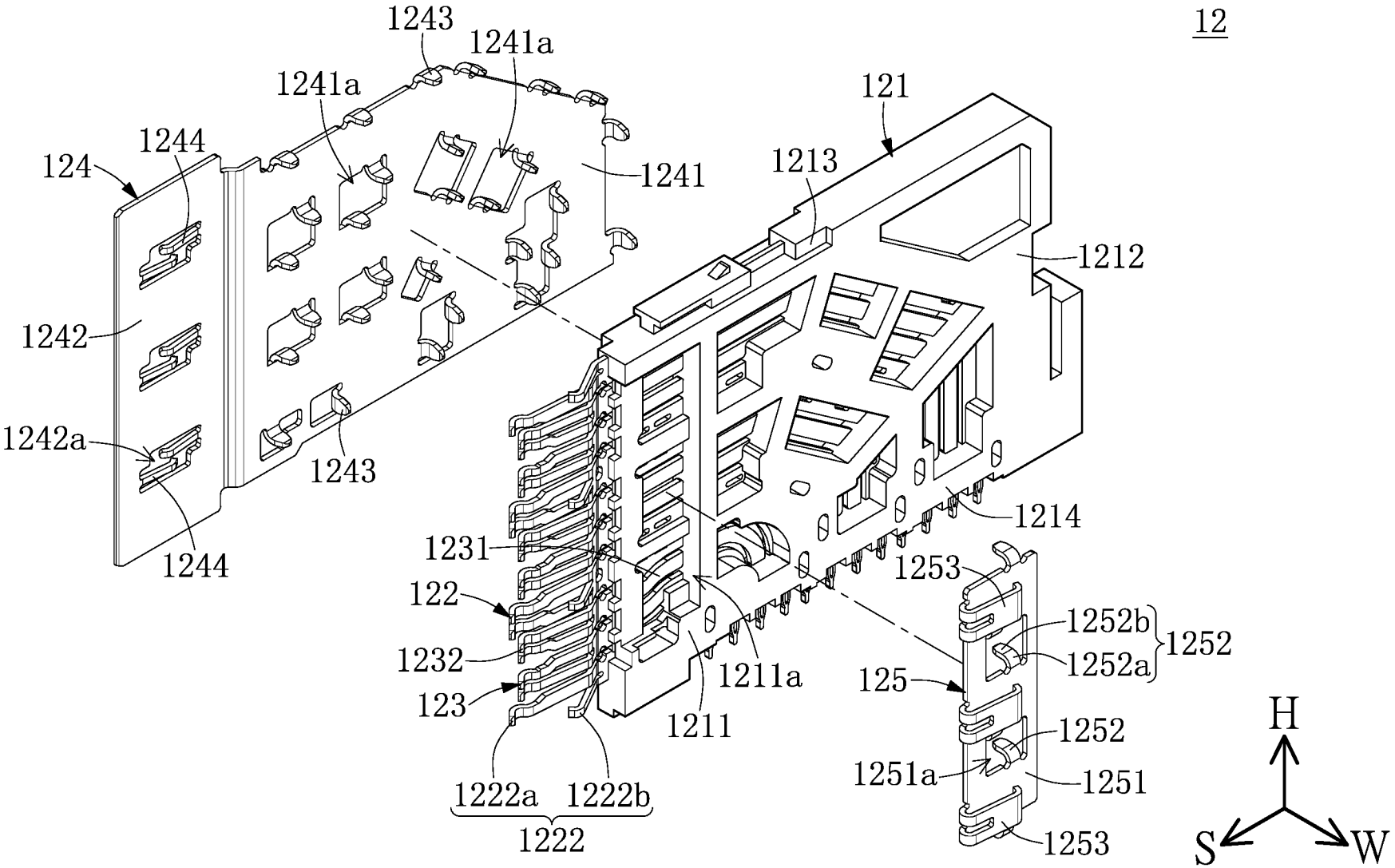
FIG. 6 is an exploded view of the transmission wafer according to the first embodiment of the present disclosure.

As shown in FIG. 4 to FIG. 6, the grounding terminals 122 and the signal terminals 123 are disposed in a staggered arrangement, and any two of the grounding terminals 122 adjacent to each other are provided with two of the signal terminals 123 there-between that can be used to jointly transmit differential signals. Each of the grounding terminals 122 is integrally formed as a one-piece structure, and includes a middle grounding segment 1221 fixed in the insulating frame 121, a front grounding segment 1222 extending (e.g., perpendicularly) from one end of the middle grounding segment 1221 to protrude from the front end portion 1211, and at least one rear grounding segment 1223 extending (e.g., perpendicularly) from the other end of the middle grounding segment 1221 to protrude from the bottom end portion 1214.

Moreover, each of the signal terminals 123 is integrally formed as a one-piece structure, and includes a middle signal segment 1231 fixed in the insulating frame 121, a front signal segment 1232 extending (e.g., perpendicularly) from one end of the middle signal segment 1231 to protrude from the front end portion 1211, and a rear signal segment 1233 extending (e.g., perpendicularly) from the other end of the middle signal segment 1231 to protrude from the bottom end portion 1214.

Specifically, two of the grounding terminals 122 located at the outermost position each have a first contacting portion 1222*a* and a second contacting portion 1222*b* both arranged on the front grounding segment 1222 thereof, and the front grounding segment 1222 of each of the other grounding terminals 122 has two first contacting portions 1222*a* and a second contacting portion 1222*b* arranged between the first contacting portions 1222*a*. In other words, any one of the grounding terminals 122 arranged between two of the signal terminals 123 includes two first contacting portions 1222*a* and a second contacting portion 1222*b*, which are arranged on the front grounding segment 1222 thereof, but the present disclosure is not limited thereto.

Figure 17:
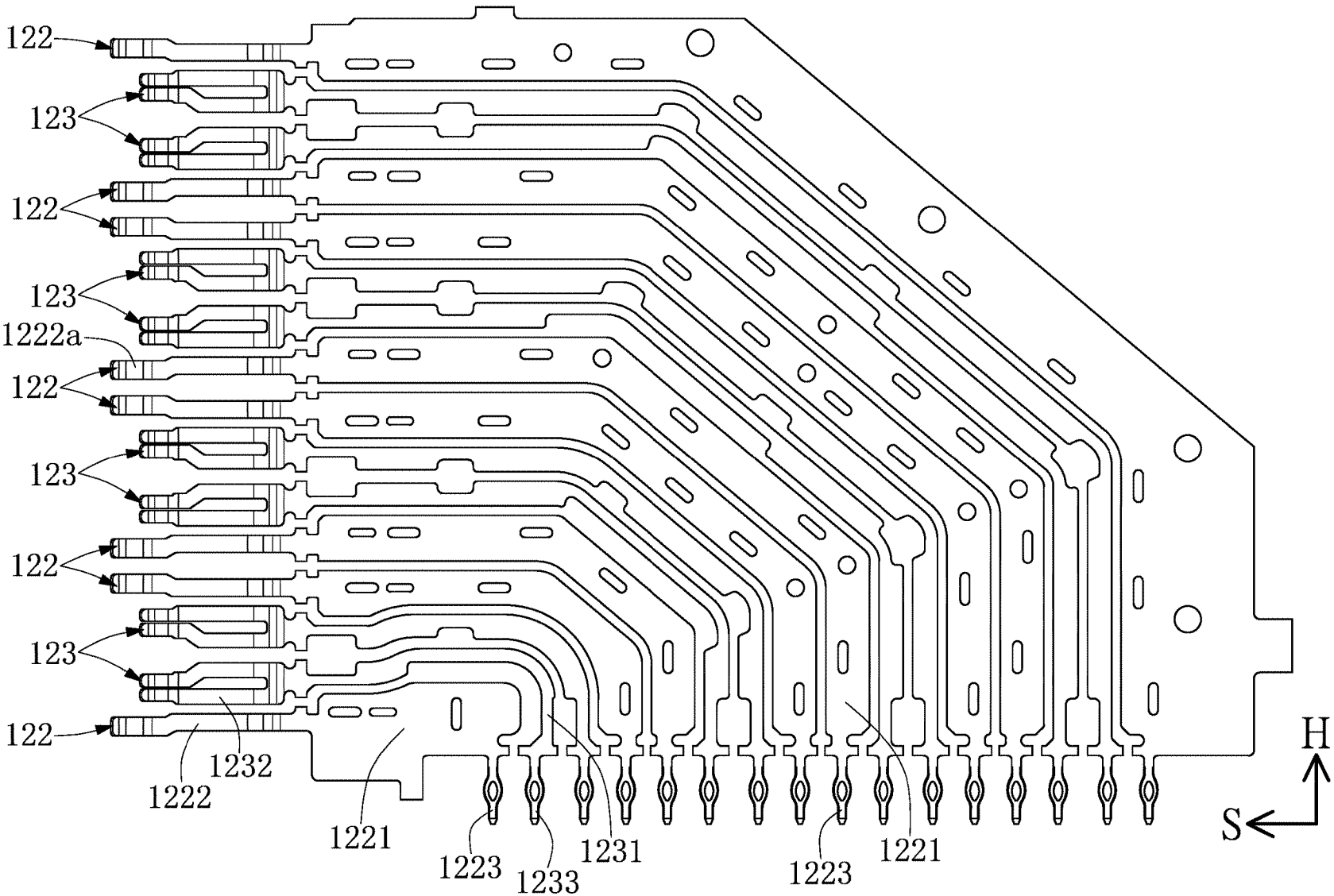
FIG. 17 is a planar view showing signal terminals and grounding terminals of a transmission wafer in another configuration according to the first embodiment of the present disclosure.

For example, as shown in FIG. 17, the grounding terminals 122 and the signal terminals 123 are disposed in a staggered arrangement, and two pairs of the signal terminals 123 adjacent to each other are provided with two of the grounding terminals 122 that are arranged there-between and that can each have one first contacting portion 1222*a* according to design requirements. In other embodiments of the present disclosure, at least one of the grounding terminals 122 of the transmission wafer 12 includes two first contacting portions 1222*a* spaced apart from each other, and at least one of the grounding terminals 122 of the transmission wafer 12 includes a second contacting portion 1222*b*.

Moreover, the first contacting portions 1222*a* and the second contacting portions 1222*b* in the present embodiment are cantilever structures. A position of each of the first contacting portions 1222*a* used to abut against a corresponding terminal of the male connector 2 is spaced apart from the front end portion 1211 by a first distance, and a position of each of the second contacting portions 1222*b* used to abut against a corresponding terminal of the male connector 2 is spaced apart from the front end portion 1211 by a second distance less than the first distance. When the female connector 1 is inserted into the male connector 2, each of the first contacting portions 1222*a* is configured to be applied with a force so as to move along a first direction (e.g., the width direction W toward the right side shown in FIG. 6), and each of the second contacting portions 1222*b* is configured to be applied with a force so as to move along a second direction (e.g., the width direction W toward the left side shown in FIG. 6) opposite to the first direction.

In addition, the front grounding segment 1222 of each of the grounding terminals 122 protrudes from the front signal segment 1232 of any one of the signal terminals 123. When the female connector 1 is inserted into the male connector 2, each of the signal terminals 123 is configured to be applied with a force so as to move along a third direction parallel to the first direction.

Figure 7:
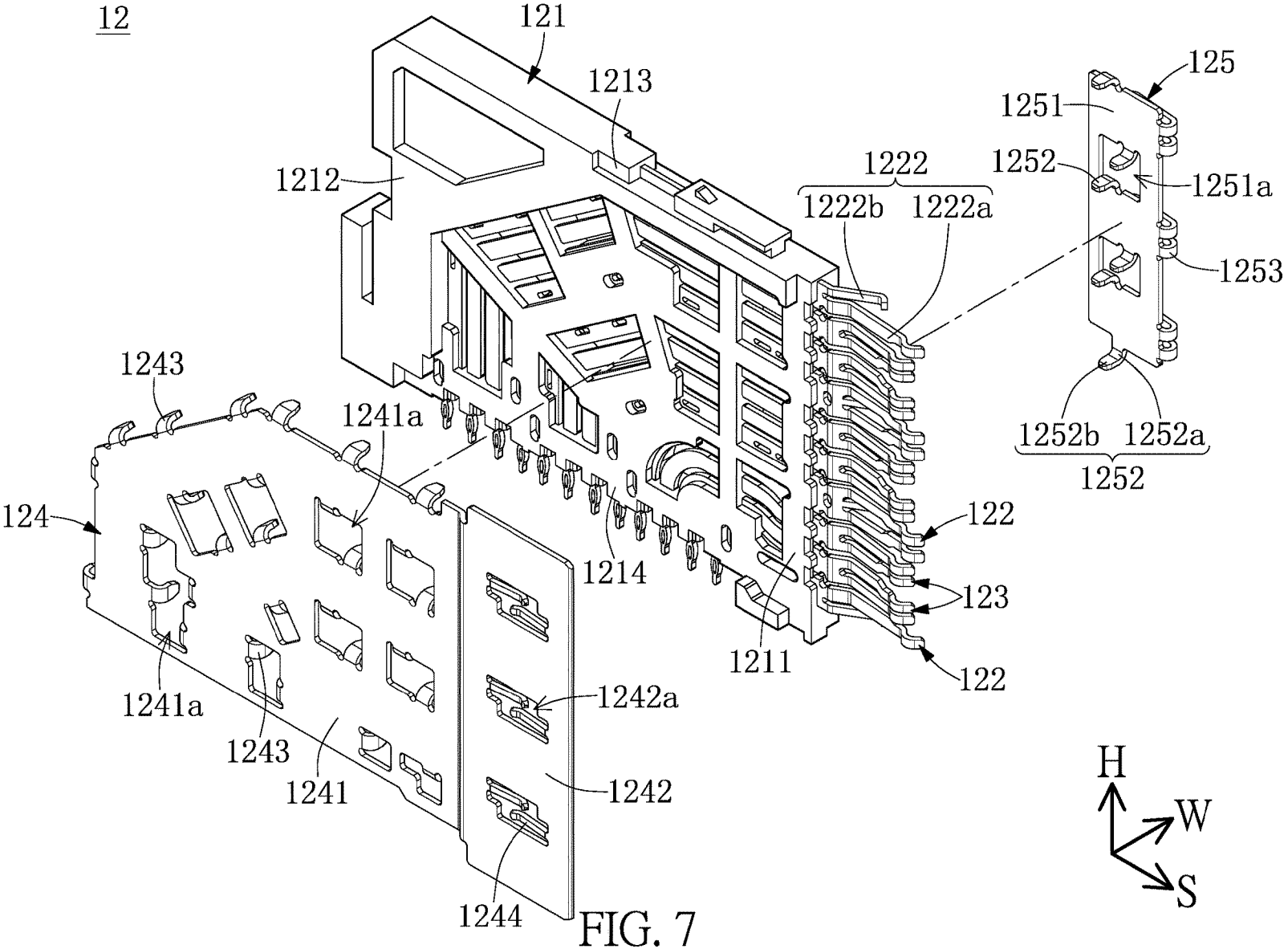
FIG. 7 is an exploded view showing the transmission wafer of FIG. 6 in another angle of view.

As shown in FIG. 5 to FIG. 7, each of the first shielding member 124 and the second shielding member 125 in the present embodiment is integrally formed as a one-piece structure and is formed by punching and bending a metal sheet. The size of the first shielding member 124 is larger than that of the second shielding member 125. The first shielding member 124 includes a middle grounding sheet 1241, a front grounding sheet 1242 extending from a front edge of the middle grounding sheet 1241, a plurality of internally connecting arms 1243 curvedly extending from the middle grounding sheet 1241, and a plurality of externally connecting arms 1244 curvedly extending from the middle grounding sheet 1241.

Specifically, each of the middle grounding sheet 1241 and the front grounding sheet 1242 has a plurality of openings 1241*a*, 1242*a*. The internally connecting arms 1243 substantially and perpendicularly extend from peripheral edges of the middle grounding sheet 1241 and inner walls defining the openings 1241*a*, respectively. The externally connecting arms 1244 extend from inner walls of the front grounding sheet 1242 defining the openings 1242*a*, respectively.

The middle grounding sheet 1241 of the first shielding member 124 is disposed onto a side surface of the insulating frame 121, and the first shielding member 124 is fixed to the middle grounding segment 1221 of each of the grounding terminals 122. In the present embodiment, the first shielding member 124 uses the internally connecting arms 1243 such that the internally connecting arms 1243 are respectively inserted into and fixed to the middle grounding segments 1221 of the grounding terminals 122, so that the first shielding member 124 can be electrically connected to each of the grounding terminals 122. It should be noted that in order to adjust the proportion of the part of the grounding terminals 122 exposed in the air, which facilitates high frequency signal transmission, part of the internally connecting arms 1243 can each be inserted into the corresponding grounding terminal 122 by passing through the insulating frame 121.

Moreover, a first projection region defined by orthogonally projecting the middle signal segment 1231 of each of the signal terminals 123 onto the first shielding member 124 is located inside of an outer contour (e.g., an outer contour of the middle grounding sheet 1241) of the first shielding member 124. In addition, second projection regions respectively defined by orthogonally projecting the grounding terminals 122 each having the two first contacting portions 1222*a* onto the first shielding member 124 cover the openings 1241*a* of the middle grounding sheet 1241, and the two first contacting portions 1222*a* of each of the grounding terminals 122 defines (or forms) a portion of the corresponding second projection region that is arranged between two adjacent openings 1242*a* of the front grounding sheet 1242.

Figure 8:
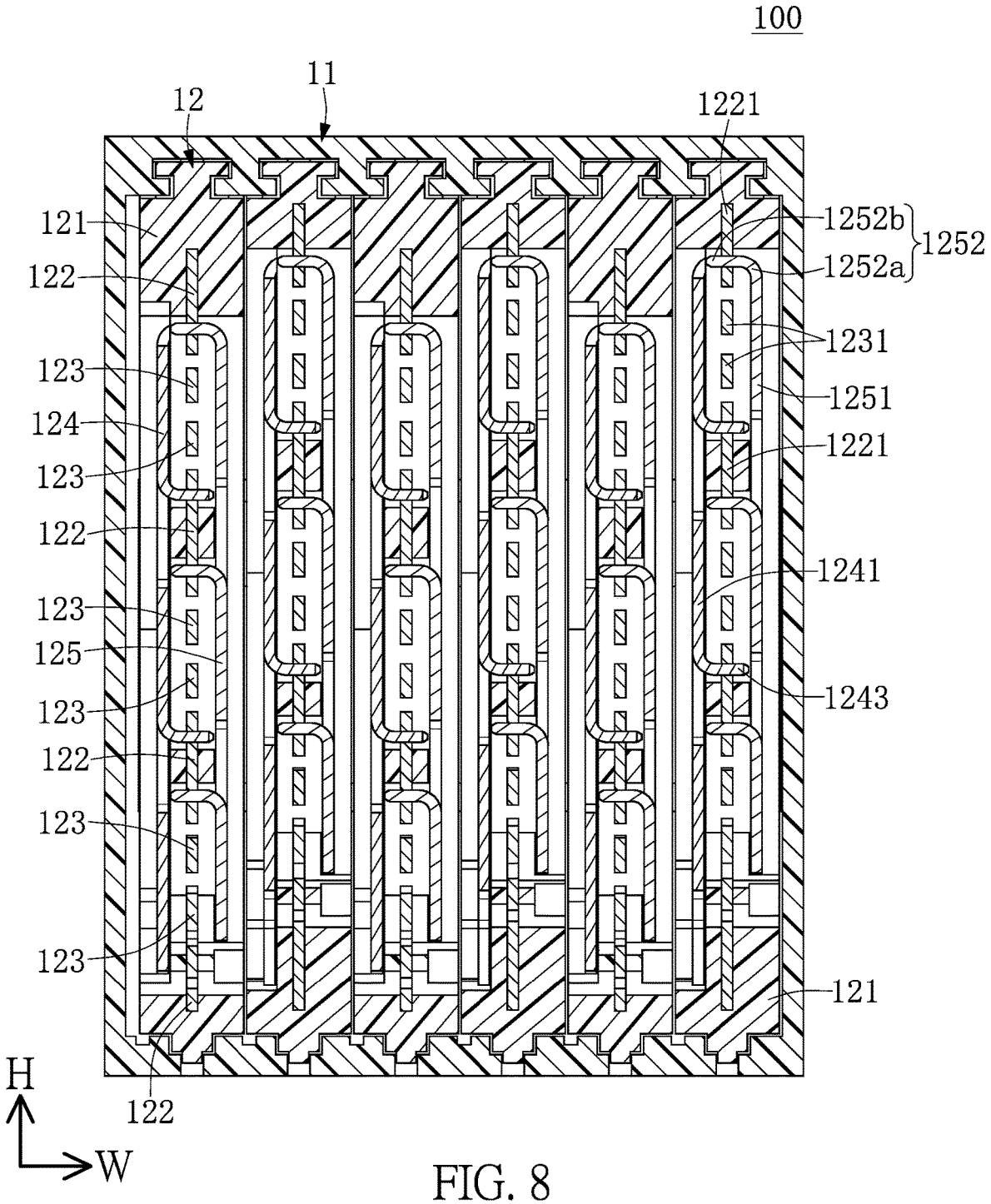
FIG. 8 is a cross-sectional view taken along line VIII-VIII of FIG. 1.

As shown in FIG. 6 to FIG. 8, the second shielding member 125 includes a plate 1251, a plurality of internally connecting arms 1252 curvedly extending from the plate 1251, and a plurality of externally connecting arms 1253 curvedly extending from the plate 1252. In the present embodiment, the plate 1251 is substantially in a rectangular shape and has a plurality of openings 1251*a*. The plate 1251 includes two opposite long edges and two opposite short edges that are perpendicular to any one of the two long edges. The internally connecting arms 1252 substantially and perpendicularly extend from inner walls defining the openings 1251*a*, respectively. The externally connecting arms 1253 curvedly extend from one of the two long edges toward the other one of the two long edges, and a length of each of the externally connecting arms 1253 is preferably larger than ⅓ of a length of each of the two short edges. Specifically, each of the openings 1251*a* is arranged between two third projection regions defined by orthogonally projecting two of the externally connecting arms 1253 adjacent to each other onto the plate 1251.

Moreover, any one of the externally connecting arms 1253 of the second shielding member 125 corresponds in position along a normal direction of the plate 1251 to two of the signal terminals 123 adjacent to each other. In other words, each of the openings 1251*a* of the present embodiment corresponds in position along the normal direction of the plate 1251 to at least one of the grounding terminals 122.

The second shielding member 125 is disposed on the front end portion 1211 of the insulating frame 121, and is fixed to the middle grounding segment 1221 of each of the grounding terminals 122. In the present embodiment, the second shielding member 125 is arranged in the accommodating slot 1211*a* of the front end portion 1211, and uses the internally connecting arms 1252 such that the internally connecting arms 1252 are respectively inserted into and fixed to the grounding terminals 122, so that the second shielding member 125 can be electrically connected to each of the grounding terminals 122. In other words, the first shielding member 124 and the second shielding member 125 are electrically connected to each other through the grounding terminals 122.

Specifically, in the second shielding member 125 of the present embodiment, each of the internally connecting arms 1252 includes a neck portion 1252*a* extending from the plate 1251 and a head portion 1252*b* extending from the neck portion 1252*a*, and each of the head portions 1252*b* passes through a hole (not labeled) of the corresponding grounding terminal 122, so that the plate 1251 and each of the head portions 1252*b* are respectively arranged at two opposite sides of the corresponding grounding terminal 122. In other embodiments of the present disclosure, a width of the head portion 1252*b* is slightly larger than that of the neck portion 1252*a*, and is larger than that of the hole of the corresponding grounding terminal 122, so that each of the internally connecting arms 1252 can be firmly fixed to the corresponding grounding terminal 122. In addition, since the structure of the internally connecting arm 1243 of the first shielding member 124 is similar to that of the internally connecting arm 1252, the description of the structure of the internally connecting arm 1243 is omitted for the sake of brevity.

The front grounding segments 1222 of the grounding terminals 122 and the front signal segments 1232 of the signal terminals 123 of the transmission wafer 12 are inserted into the insertion portion 111 of the housing 11, the front grounding sheet 1242 of the first shielding member 124 is arranged in the insertion portion 111, and at least 80% area of the second shielding member 125 and the corresponding components are arranged in the insertion portion 111. In the transmission wafer 12 and the corresponding row of the terminal holes 1111, the first contacting portions 1222*a* of the grounding terminals 122 and the externally connecting arms 1244 of the first shielding member 124 substantially correspond in position to the grounding thru-holes 1112, and the front signal segments 1232 of the signal terminals 123 substantially correspond in position to the signal thru-holes 1113.

Figure 9:
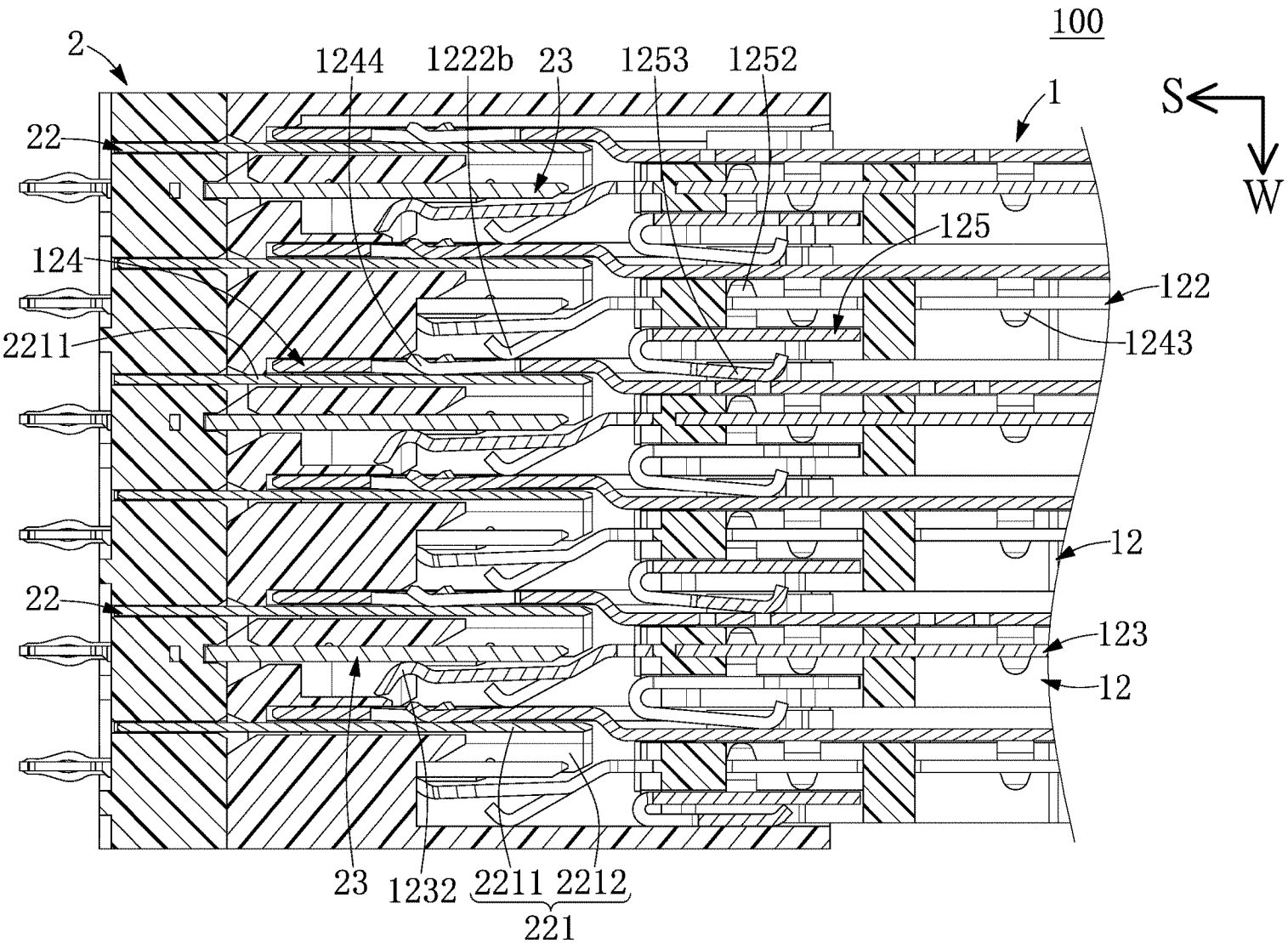
FIG. 9 is a cross-sectional view taken along line IX-IX of FIG. 1.
Figure 10:
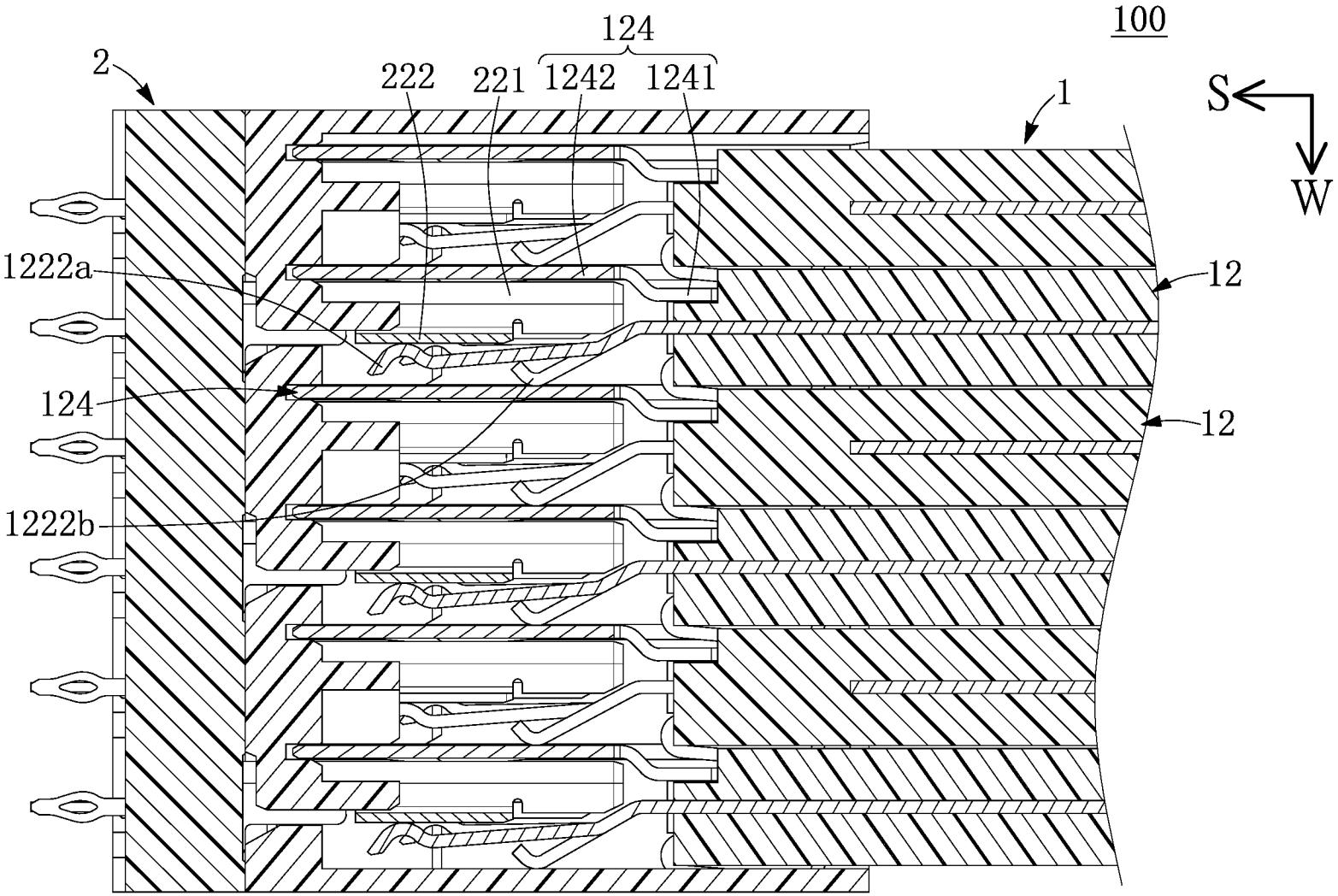
FIG. 10 is a cross-sectional view taken along line X-X of FIG. 1.

The above description describes the structure of the single transmission wafer 12 of the present embodiment, and the following description proceeds to describe the connection relationship of the transmission wafers 12. As shown in FIG. 9 and FIG. 10, in two of the transmission wafers 12 adjacent to each other (i.e., the two adjacent transmission wafers 12), the externally connecting arms 1253 of the second shielding member 125 of one of the two adjacent transmission wafers 12 are elastically abutted against and electrically connected to the first shielding member 124 (e.g., the middle grounding sheet 1241 of that) of the other one of the two adjacent transmission wafers 12. Accordingly, the first shielding members 124, the second shielding members 125, and the grounding terminals 122 of the two adjacent transmission wafers 12 can be electrically connected to each other to be commonly grounded, so that the crosstalk of the female connector 1 can be effectively improved.

Moreover, in two of the transmission wafers 12 adjacent to each other, the second contacting portion 1222*b* of at least one of the grounding terminals 122 of one of the two adjacent transmission wafers 12 can be abutted against and electrically connected to the first shielding member 124 (e.g., the front grounding sheet 1242 of that) of the other one of the two adjacent transmission wafers 12, thereby further ensuring the common ground effect between the two adjacent transmission wafers 12. In addition, as shown in FIG. 17, the second contacting portion 1222*b* can be omitted according to design requirements. For example, if two adjacent transmission wafers 12 can be commonly grounded through the externally connecting arms 1253 of the second shielding members 125, then the second contacting portion 1222*b* can be omitted.

Figure 11:
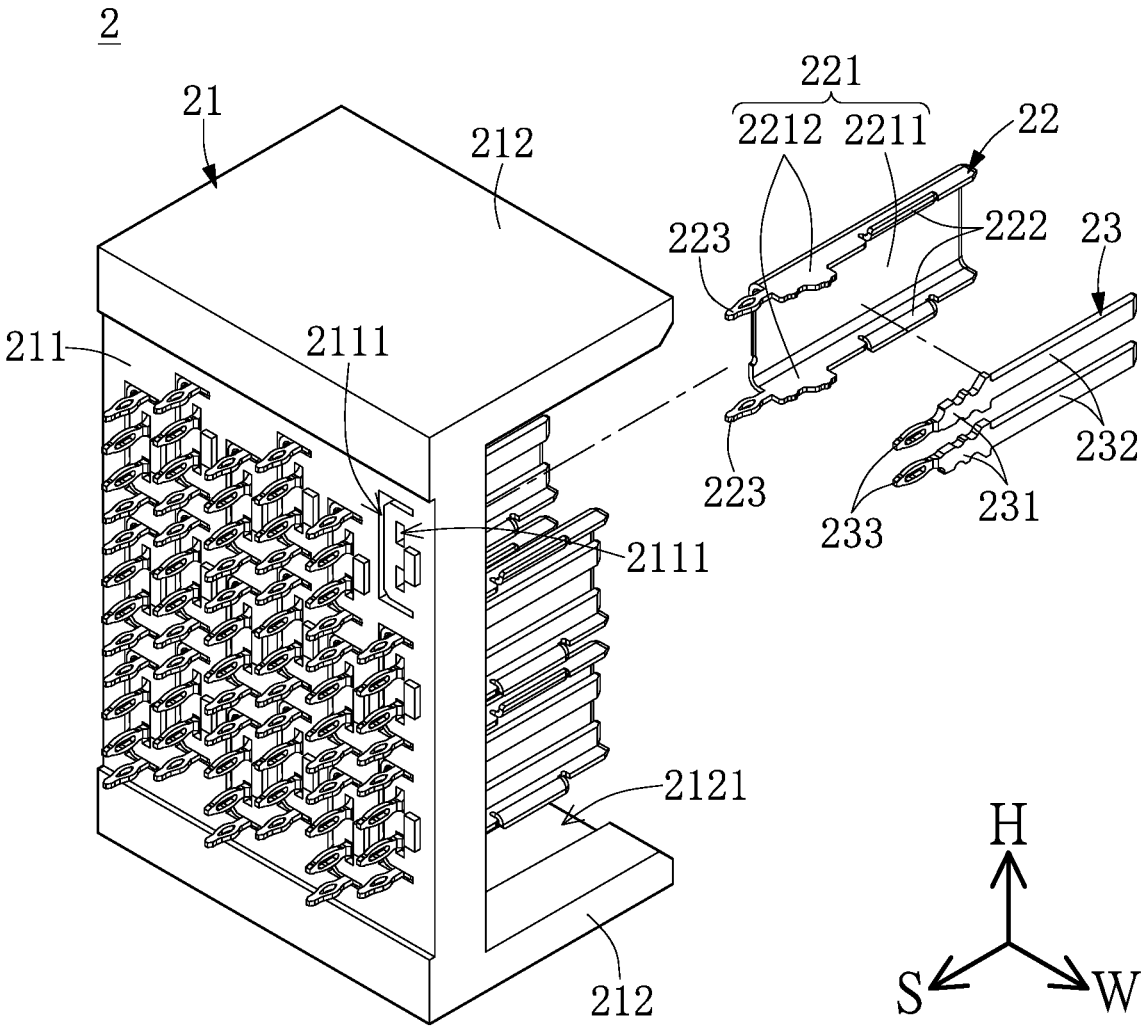
FIG. 11 is an exploded view of a male connector according to the first embodiment of the present disclosure.

As shown in FIG. 2 and FIG. 11, the male connector 2 includes a carrier 21, a plurality of shielding terminals 22 fixed to the carrier 21, and a plurality of conductive terminals 23 fixed to the carrier 21. The carrier 21 in the present embodiment is substantially a U-shaped structure, and includes a bottom board 211 and two side boards 212 respectively and perpendicularly connected to two opposite edges of the bottom board 211. The shielding terminals 22 and the conductive terminals 23 are fixed to the bottom board 211 of the carrier 21.

Specifically, the bottom board 211 has a plurality of fixing holes 2111 arranged in rows, and the rows of the fixing holes 2111 respectively correspond in position and shape to the rows of the terminal holes 1111 of the housing 11, but the present disclosure is not limited thereto.

Moreover, each of the two side boards 212 has a positioning groove 2121 parallel to the insertion direction S, and the positioning grooves 2121 of the two side boards 212 respectively correspond in position and shape to the two guiding columns 113 of the housing 11. Accordingly, when the female connector 1 is inserted into the male connector 2, the housing 11 and the carrier 21 can be precisely connected to each other by respectively inserting the two guiding columns 113 into the two positioning grooves 2121.

As the shielding terminals 22 are of the same structure, the following description discloses the structure of only one of the shielding terminals 22 for the sake of brevity, but the present disclosure is not limited thereto. For example, in other embodiments of the present disclosure, the shielding terminals 22 of the male connector 2 can have a different structure.

As shown in FIG. 11, the shielding terminal 22 is integrally formed as a one-piece structure, and includes a U-shaped sheet 221, two wing portions 222 respectively connected to two opposite sides of the U-shaped sheet 221, and two tail portions 223 connected to a bottom edge of the U-shaped sheet 221. The U-shaped sheet 221 in the present embodiment has a U-shaped cross-section perpendicular to the insertion direction S.

Specifically, the U-shaped sheet 221 includes a bottom wall 2211 and two side walls 2212 respectively connected to the bottom wall 2211. The two wing portions 222 are curvedly connected to the two side walls 2212, respectively. The two tail portions 223 respectively extend from bottom edges of the two side walls 2212 along the insertion direction S. Moreover, each of the two wing portions 222 is an elongated structure parallel to the insertion direction S, and the two wing portions 222 respectively and perpendicularly extend from lateral edges of the two side walls 2212 along two different directions away from each other.

Each of the conductive terminals 23 is integrally formed as a one-piece structure, and includes a fixing portion 231, a mating portion 232, and a pin 233, the latter two of which respectively extend from two opposite sides of the fixing portion 231. The U-shaped sheet 221 of each of the shielding terminals 22 is arranged around an outer side of (the fixing portions 231 and the mating portions 232 of) two of the conductive terminals 23. The bottom wall 2211 of each of the shielding terminals 22 is parallel to a width direction of the fixing portion 231 and a width direction of the mating portion 232 of the corresponding conductive terminal 23. Moreover, a width direction of each of the tail portions 223 of the shielding terminal 22 is substantially perpendicular to that of the pin 233 of the corresponding conductive terminal 23.

The above description describes the structure of the single shielding terminal 22 of the present embodiment, and then the following description describes the connection relationship of the shielding terminals 22. As shown in FIG. 2, the shielding terminals 22 in the present embodiment are arranged in a plurality of rows, and each of the rows of the shielding terminals 22 has a longitudinal direction parallel to the height direction H. In two of the shielding terminals 22 adjacent to each other and arranged in the same row (e.g., the two adjacent shielding terminals 22), two of the side walls 2212 (or the wing portions 222) adjacent to each other and respectively arranged on the two adjacent shielding terminals 22 are arranged to face each other. Moreover, in each of the rows of the shielding terminals 22 and the corresponding conductive terminals 23, the bottom walls 2211 are arranged on a first plane perpendicular to the width direction W, and the wing portions 222 and the conductive terminals 23 are arranged on a second plane parallel to the first plane (or perpendicular to the width direction W).

Specifically, as shown in FIG. 2 and FIG. 11, each of the rows of the shielding terminals 22 and the corresponding conductive terminals 23 are inserted into and fixed to one of the rows of the fixing holes 2111 of the bottom board 211 of the carrier 21. Each of the shielding terminals 22 is fixed to the bottom board 211 by using an embedded portion of the U-shaped sheet 221 adjacent to the tail portion 223 to insert into the corresponding fixing hole 2111. Each of the conductive terminals 23 is fixed to the bottom board 211 by inserting the fixing portion 231 into the corresponding fixing hole 2111.

The two wing portions 222, an exposed portion of the U-shaped sheet 221 arranged away from the tail portions 223 of each of the shielding terminals 22, and the mating portion 232 of each of the conductive terminals 23 are arranged between the two side boards 212 of the carrier 21. Moreover, in each of the shielding terminals 22, each of the two wing portions 222 substantially corresponds in position to (or is connected to) a center segment of the exposed portion of the U-shaped sheet 221, but the present disclosure is not limited thereto.

As shown in FIG. 2, when the female connector 1 is inserted into the male connector 2, any one of the rows of the shielding terminals 22 and the corresponding conductive terminals 23 of the male connector 2 can pass through one of the rows of the terminal holes 1111 of the housing 11 of the female connector 1 so as to connect to the grounding terminals 122, the signal terminals 123, and the first shielding member 124, which correspond in position to the one row of the terminal holes 1111.

Figure 12:
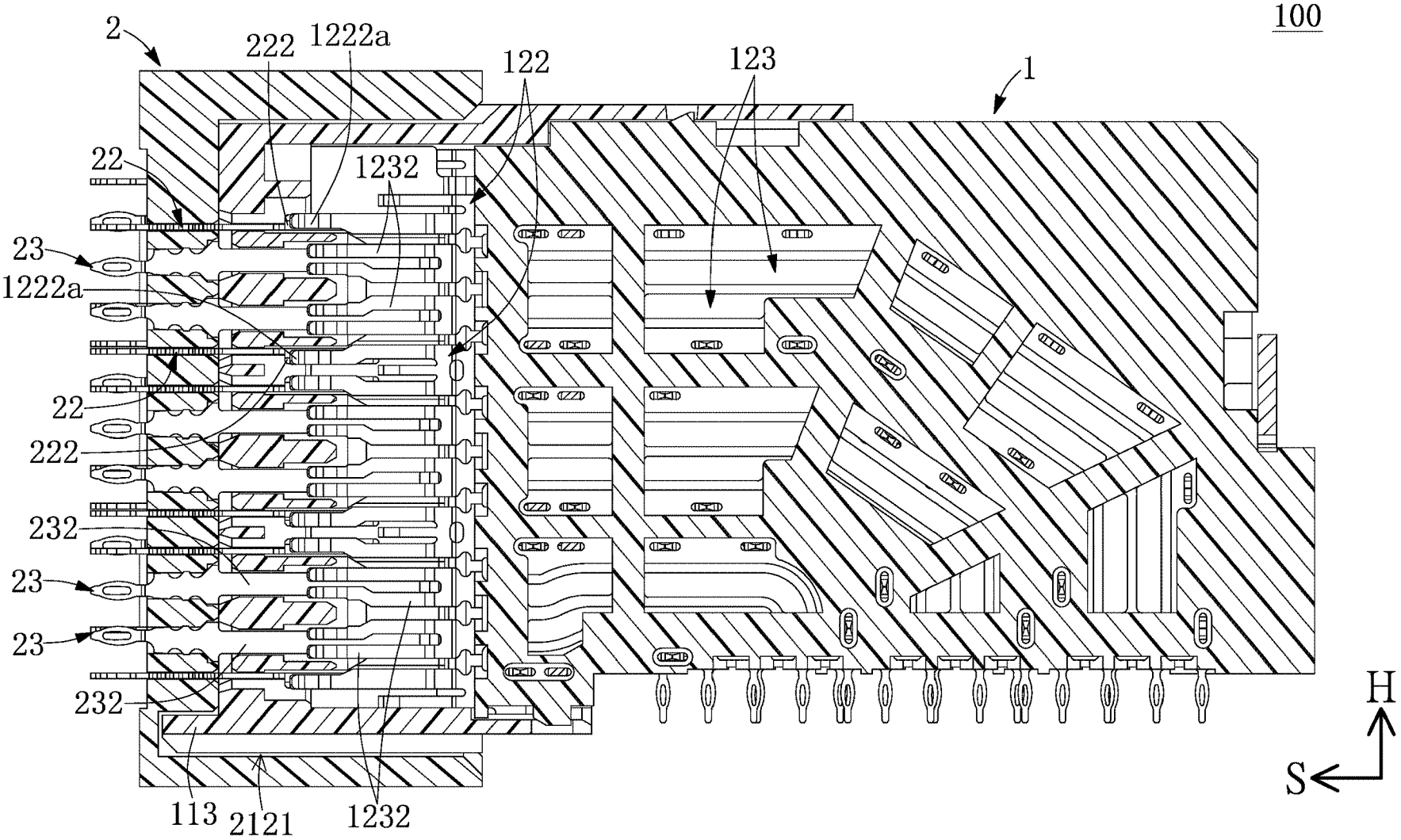
FIG. 12 is a cross-sectional view taken along line XII-XII of FIG. 1.

Specifically, as shown in FIG. 12, at least one of the shielding terminals 22 of the male connector 2 is abutted against two of the grounding terminals 122 of the female connector 1. In the present embodiment, the two wing portions 222 of the at least one of the shielding terminals 22 of the male connector 2 are respectively abutted against and electrically connected to the first contacting portions 1222*a* of the two grounding terminals 122 of the female connector 1. In other words, the two first contacting portions 1222*a* of at least one of the grounding terminals 122 are respectively abutted against and electrically connected to the wing portions 222 of two of the shielding terminals 22 adjacent to each other, but the present disclosure is not limited thereto.

For example, as shown in FIG. 17, in any two of the grounding terminals 122 adjacent to each other (i.e., the two adjacent grounding terminals 122), the first contacting portion 1222*a* of one of the two adjacent grounding terminals 122 is configured to be abutted against and electrically connected to the wing portion 222 of one of the two adjacent shielding terminals 22, and the first contacting portion 1222*a* of the other one of the two adjacent grounding terminals 122 is configured to be abutted against and electrically connected to the wing portion 222 of the other one of the two adjacent shielding terminals 22.

Accordingly, the shielding terminals 22 in the male connector 2 and the grounding terminals 122 in the female connector 1 can be connected in a one-to-plurality manner, thereby improving the common ground effect and the crosstalk of the electrical connector assembly 100.

Moreover, since the two wing portions 222 of each of the shielding terminals 22 are formed by respectively and perpendicularly extending from the lateral edges of the two side walls 2212, each of the two wing portions 222 is abutted against the corresponding first contacting portion 1222*a* by a broad surface thereof. Accordingly, the shielding terminal 22 and the corresponding grounding terminal 122 can be firmly connected to each other by the cooperation of the wing portion 222 and the first contacting portion 1222*a*, thereby providing a better electrical transmission performance, but the present disclosure is not limited thereto. For example, in other connectors oriented toward high-density or miniaturization, when an interval between any two adjacent terminals is too narrow, the wing portions 222 can be omitted, and the first contacting portion 1222*a* of the grounding terminal 122 is direct abutted against the lateral edge (or the cutting edge) of the side wall 2212 of the corresponding shielding terminal 22.

In addition, the externally connecting arms 1244 of each of the first shielding members 124 are abutted against an outer surface of the bottom wall 2211 of the U-shaped sheet 221 of the corresponding shielding terminal 22 (shown in FIG. 9), and the front signal segments 1232 of the two adjacent signal terminals 123 are respectively abutted against the mating portions 232 of two of the conductive terminals 23 (shown in FIG. 12).

Second Embodiment

Figure 13:
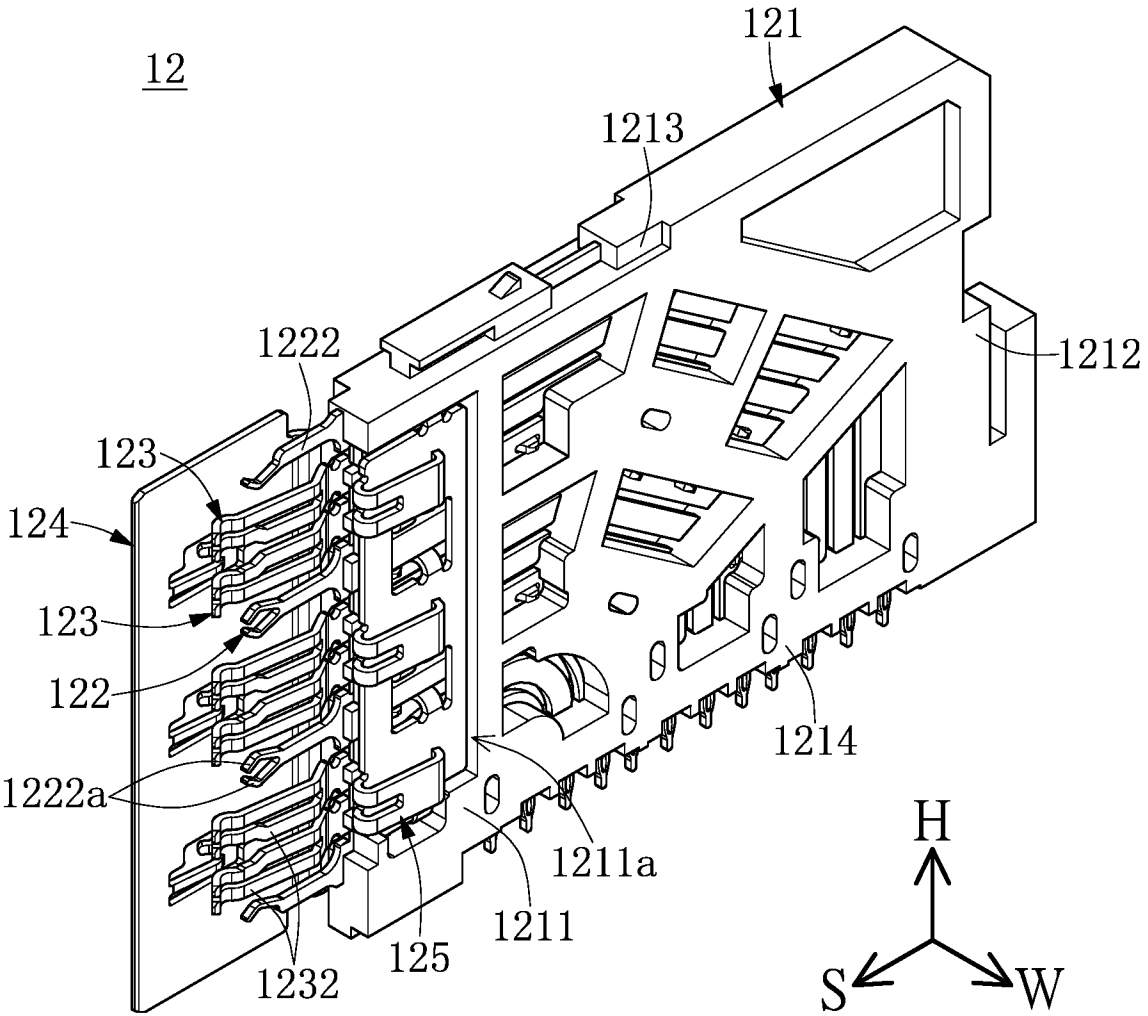
FIG. 13 is a perspective view of a transmission wafer according to a second embodiment of the present disclosure.
Figure 14:
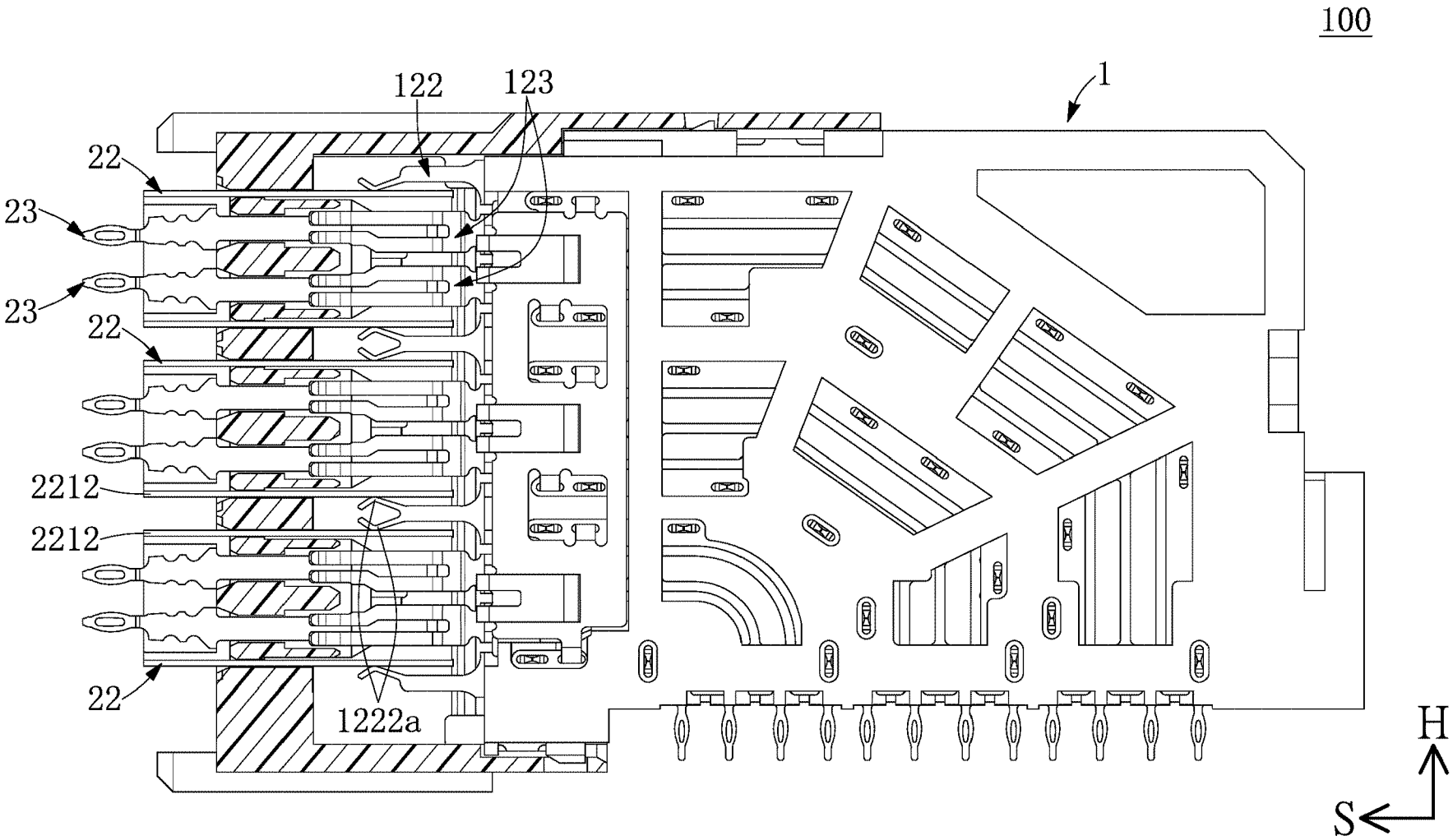
FIG. 14 is a cross-sectional view showing an electrical connector assembly according to the second embodiment of the present disclosure.

Referring to FIG. 13 and FIG. 14, a second embodiment of the present disclosure is similar to the first embodiment of the present disclosure, so that the descriptions of the same components in the first and second embodiments of the present disclosure will be omitted for the sake of brevity, and the following description only discloses different features between the first and second embodiments (e.g., the female connector 1).

In the present embodiment, each of the grounding terminals 122 is not formed with the second contacting portion 1222*b*, and the front signal segment 1232 of each of the signal terminals 123 protrudes from the first contacting portions 1222*a* of any one of the grounding terminals 122. When the female connector 1 is inserted into the male connector 2, each of the first contacting portions 1222*a* is configured to be applied with a force so as to move along a first direction (e.g., the height direction H), each of the signal terminals 123 is configured to be applied with a force so as to move along a second direction (e.g., the width direction W) that is perpendicular to the first direction, and the two first contacting portions 1222*a* of at least one of the grounding terminals 122 are configured to be applied with a force so as to move toward each other closely (or so as to move in two opposite directions).

Moreover, the first contacting portions 1222*a* of any one of the grounding terminals 122 are abutted against the side walls 2212 of the two corresponding shielding terminals 22, so that each of the shielding terminals 22 in the present embodiment can be formed without any wing portions 222.

Third Embodiment

Figure 15:
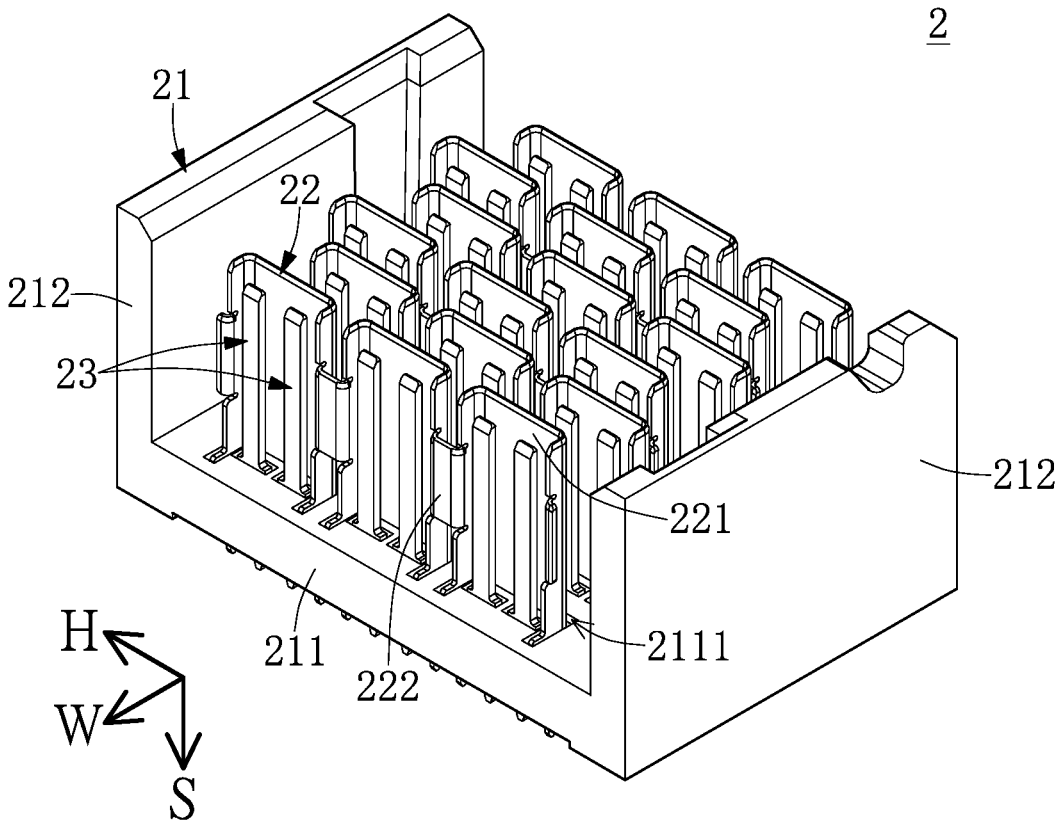
FIG. 15 is a perspective view of a male connector according to a third embodiment of the present disclosure.

Referring to FIG. 15, a third embodiment of the present disclosure is similar to the first embodiment of the present disclosure, so that the descriptions of the same components in the first and third embodiments of the present disclosure will be omitted for the sake of brevity, and the following description only discloses different features between the first and third embodiments (e.g., the male connector 2).

In the present embodiment, each of the rows of the shielding terminals 22 is integrally formed as a one-piece structure. In other words, in the two adjacent shielding terminals 22 arranged in the same row, two of the wing portions 222 respectively connected to the two adjacent side walls 2212 facing each other are integrally connected to each other, but the present disclosure is not limited thereto. For example, in other embodiments of the present disclosure, in each of the rows of the shielding terminals 22, only two of the shielding terminals 22 adjacent to each other are integrally formed as a one-piece structure.

Fourth Embodiment

Figure 16:
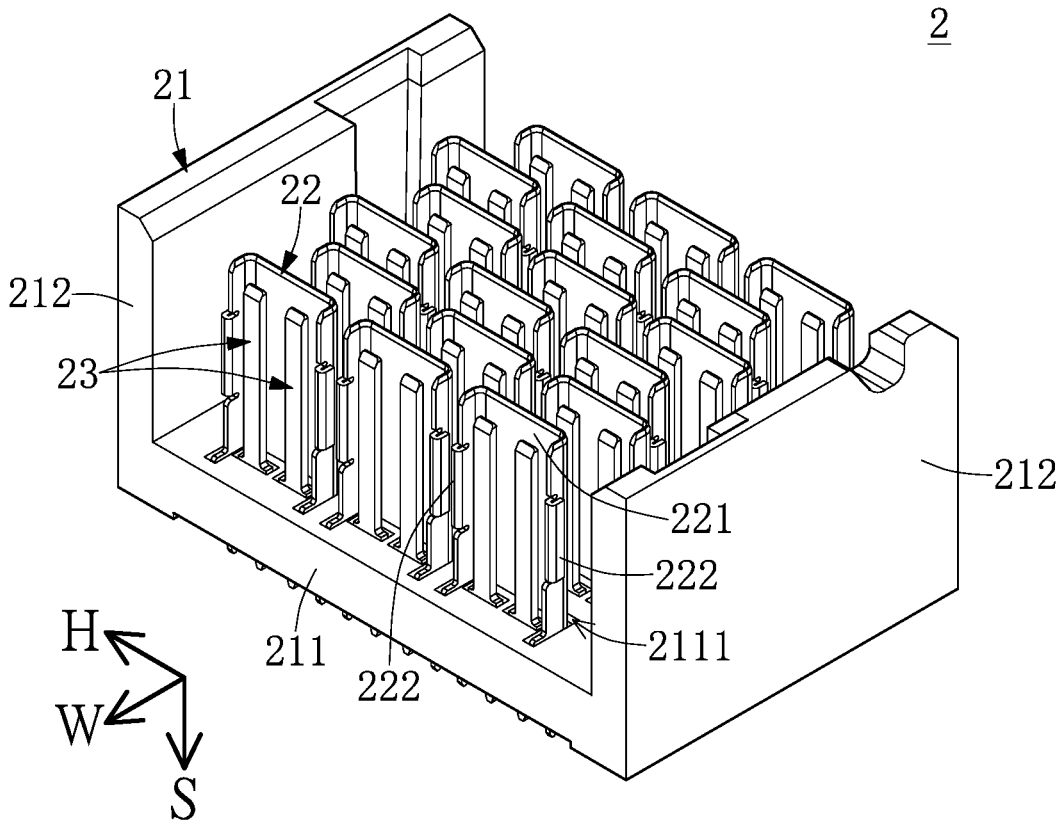
FIG. 16 is a perspective view of a male connector according to a fourth embodiment of the present disclosure.

Referring to FIG. 16, a fourth embodiment of the present disclosure is similar to the first embodiment of the present disclosure, so that the descriptions of the same components in the first and fourth embodiments of the present disclosure will be omitted for the sake of brevity, and the following description only discloses different features between the first and fourth embodiments (e.g., the male connector 2).

In each of the shielding terminals 22 of the present embodiment, each of the two wing portions 222 includes a folded structure having a bending corner at 180 degrees, so that a contact area of each of the wing portions 222 (i.e., the folded structure) with respect to the corresponding first contacting portion 1222*a* is increased (compared to the male connector 2 that the shielding terminal 22 is not formed with the wing portions 222), and a portion of each of the two wing portions 222 between a free end and the bending corner is substantially parallel to one of the two side walls 2212 adjacent thereto. In other words, a thickness of each of the two wing portions 222 in the height direction H is two times of a thickness of the material (e.g., a metal sheet used to form the shielding terminal 22).

In conclusion, each of the transmission wafers of the female connector of the present disclosure are provided with the first shielding member and the second shielding member that are electrically connected to the grounding terminals, and the second shielding member of one of the two adjacent transmission wafers is elastically abutted against and electrically connected to the first shielding member of the other one of the two adjacent transmission wafers. Accordingly, the first shielding members, the second shielding members, and the grounding terminals of the two adjacent transmission wafers can be electrically connected to each other to establish a common ground effect, so that the crosstalk of the female connector can be effectively improved.

Moreover, the shielding terminals in the male connector and the grounding terminals in the female connector can be connected in a one-to-plurality manner, thereby improving the common ground performance and the crosstalk of the electrical connector assembly of the present disclosure.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An electrical connector assembly, comprising:

a female connector including:

a housing; and a plurality of transmission wafers stacked in one pile and inserted into the housing, wherein each of the transmission wafers includes an insulating frame and a plurality of grounding terminals fixed to the insulating frame; and a male connector detachably inserted into the female connector and including:

a carrier; and a plurality of shielding terminals fixed to the carrier, wherein at least one of the grounding terminals of each of the transmission wafers includes two first contacting portions that are spaced apart from each other and are respectively abutted against and electrically connected to two of the shielding terminals adjacent to each other.

2. The electrical connector assembly according to claim 1, wherein the male connector includes a plurality of conductive terminals fixed to the carrier, and each of the shielding terminals includes a U-shaped sheet and two wing portions respectively connected to two opposite sides of the U-shaped sheet, and wherein the U-shaped sheet of each of the shielding terminals is arranged around an outer side of two of the conductive terminals, and the two wing portions of at least one of the shielding terminals are respectively abutted against and electrically connected to two of the grounding terminals of the female connector.

3. The electrical connector assembly according to claim 2, wherein in each of the shielding terminals, the U-shaped sheet includes a bottom wall and two side walls connected to the bottom wall, and the two wing portions are curvedly connected to the two side walls, respectively, and wherein the shielding terminals are arranged in a plurality of rows, and in two of the shielding terminals adjacent to each other and arranged in the same row, two of the side walls adjacent to each other and respectively arranged on the two adjacent shielding terminals face each other.

4. The electrical connector assembly according to claim 3, wherein in the two adjacent shielding terminals arranged in the same row, two of the wing portions respectively connected to the two adjacent side walls facing each other are integrally connected to each other.

5. The electrical connector assembly according to claim 3, wherein in each of the rows of the shielding terminals and the corresponding conductive terminals, the bottom walls are arranged on a first plane, and the wing portions and the conductive terminals are arranged on a second plane parallel to the first plane.

6. The electrical connector assembly according to claim 1, wherein each of the transmission wafers includes a plurality of signal terminals, and wherein in each of the transmission wafers, two of the grounding terminals adjacent to each other are provided with two of the signal terminals therebetween as a pair of signal terminals for differential signals, and the at least one of the grounding terminals having the two first contacting portions is arranged between two adjacent pairs of the signal terminals.

7. The electrical connector assembly according to claim 6, wherein each of the first contacting portions is configured to be applied with a force so as to move along a first direction, and each of the signal terminals is configured to be applied with a force so as to move along a second direction parallel to the first direction.

8. The electrical connector assembly according to claim 6, wherein each of the first contacting portions is configured to be applied with a force so as to move along a first direction, and each of the signal terminals is configured to be applied with a force so as to move along a second direction perpendicular to the first direction, and wherein the two first contacting portions of the at least one of the grounding terminals are configured to be applied with a force so as to move toward each other.

9. The electrical connector assembly according to claim 1, wherein each of the transmission wafers includes a first shielding member disposed on a side of the insulating frame, and at least one of the grounding terminals of each of the transmission wafers includes a second contacting portion, and wherein in two of the transmission wafers adjacent to each other, the second contacting portion of the at least one of the grounding terminals of one of the two adjacent transmission wafers is abutted against and electrically connected to the first shielding member of the other one of the two adjacent transmission wafers.

10. A male connector, comprising:

a carrier;

a plurality of conductive terminals fixed to the carrier; and a plurality of shielding terminals fixed to the carrier and each including a U-shaped sheet and two wing portions respectively connected to two opposite sides of the U-shaped sheet, wherein the U-shaped sheet of each of the shielding terminals is arranged around an outer side of two of the conductive terminals, and the two wing portions of each of the shielding terminals are configured to respectively abut against and electrically connect to two grounding terminals of a female connector, wherein in each of the shielding terminals, the U-shaped sheet includes a bottom wall and two side walls connected to the bottom wall, and the two wing portions are curvedly connected to the two side walls, respectively, and wherein the shielding terminals are arranged in a plurality of rows, and in two of the shielding terminals adjacent to each other and arranged in the same row, two of the side walls adjacent to each other and respectively arranged on the two adjacent shielding terminals face each other, wherein in each of the rows of the shielding terminals and the corresponding conductive terminals, the bottom walls are arranged on a first plane, and the wing portions and the conductive terminals are arranged on a second plane parallel to the first plane.

11. The male connector according to claim 10, wherein in the two adjacent shielding terminals arranged in the same row, two of the wing portions respectively connected to the two adjacent side walls facing each other are integrally connected to each other.

12. The male connector according to claim 10, wherein the shielding terminals are arranged in a plurality of rows, and each of the rows of the shielding terminals is integrally formed as a one-piece structure.

* * * * *